US008607858B2

(12) United States Patent
McKay et al.

(10) Patent No.: US 8,607,858 B2
(45) Date of Patent: Dec. 17, 2013

(54) SPIRAL WHIPSTOCK FOR LOW-SIDE CASING EXITS

(75) Inventors: Graeme D. McKay, Aberdeen (GB); Christopher W. Guidry, Spring, TX (US); Paul L. Connell, Spring, TX (US); David B. Haughton, Castle Rock, CO (US)

(73) Assignee: Baker Hughes Incorporated, Houston, TX (US)

( * ) Notice: Subject to any disclaimer, the term of this patent is extended or adjusted under 35 U.S.C. 154(b) by 91 days.

(21) Appl. No.: 13/292,744

(22) Filed: Nov. 9, 2011

(65) Prior Publication Data

US 2013/0112397 A1 May 9, 2013

(51) Int. Cl.
*E21B 23/12* (2006.01)

(52) U.S. Cl.
USPC ..... 166/117.5; 175/80

(58) Field of Classification Search
USPC ..... 166/298, 117.5, 55.2; 175/61, 65, 80, 175/82
See application file for complete search history.

(56) References Cited

U.S. PATENT DOCUMENTS

| | | | | | |
|---|---|---|---|---|---|
| 2,154,162 | A | * | 4/1939 | Hewitt, Jr. et al. | 166/66 |
| 2,451,443 | A | * | 10/1948 | Merten | 33/304 |
| 2,691,507 | A | * | 10/1954 | Brown | 166/117.5 |
| 3,116,799 | A | * | 1/1964 | Lemons | 175/61 |
| 4,527,639 | A | * | 7/1985 | Dickinson et al. | 175/61 |
| 5,474,126 | A | * | 12/1995 | Lynde et al. | 166/117.6 |
| 5,826,651 | A | * | 10/1998 | Lee et al. | 166/117.6 |
| 5,871,046 | A | | 2/1999 | Robison | |
| 6,105,675 | A | * | 8/2000 | Buytaert et al. | 166/298 |
| 6,488,090 | B1 | * | 12/2002 | Ohmer | 166/298 |
| 6,499,538 | B2 | * | 12/2002 | Dewey et al. | 166/297 |
| 6,510,898 | B1 | | 1/2003 | Buytaert | |
| 7,090,009 | B2 | * | 8/2006 | Zupanick | 166/245 |
| 2007/0187085 | A1 | * | 8/2007 | Dewey et al. | 166/55 |
| 2008/0029276 | A1 | * | 2/2008 | Templeton et al. | 166/385 |
| 2008/0185148 | A1 | * | 8/2008 | Carter et al. | 166/298 |
| 2010/0012322 | A1 | * | 1/2010 | McGarian | 166/298 |
| 2010/0270080 | A1 | * | 10/2010 | Perry et al. | 175/62 |

FOREIGN PATENT DOCUMENTS

| | | |
|---|---|---|
| WO | 9931348 | 6/1999 |

* cited by examiner

*Primary Examiner* — Daniel P Stephenson
(74) *Attorney, Agent, or Firm* — Steve Rosenblatt

(57) ABSTRACT

A whipstock features a spiral ramp so that, in a horizontal run, access to a milled window with other tools is not impeded because such tools can traverse onto the ramp and still be directed to the window. Angular rotation of the ramp can be at 180° or more and the pitch is selected to avoid getting the equipment being advanced into a bind. Optionally, a guide track can be configured into the whipstock ramp to help the mill follow the spiral path until the proper orientation is obtained and the track ends to allow separation of the mill from the track. A slot can be provided near the ramp upper end to aid in retrieval operations.

10 Claims, 7 Drawing Sheets

SPIRAL WHIPSTOCK FOR LOW-SIDE CASING EXITS

FIELD OF THE INVENTION

The field of the invention is whipstocks for subterranean use, more particularly; whipstocks deployed in horizontal or deviated wellbore sections that need a casing low-side exit.

BACKGROUND OF THE INVENTION

Whipstocks are used to open a window in casing for a lateral exit to further produce an already producing zone or to reach a new zone. They are anchored to the casing at their lower end and have a long tapered surface with some curvature to guide a milling assembly laterally against the casing wall so that an elongated opening or window is made in the casing. Typically, the milling system is deployed attached to a lug at the upper end of the whipstock ramp, and that connection is severed before the mills begin to rotate. The ramp guides the milling system as the milling system moves downward along the ramp and laterally into the wall of the casing. Near the lower end of the ramp, the mill can spiral away from the ramp, as described in U.S. Pat. No. 5,474,126.

Accurate positioning of the ramp is important so that the lateral exit window is properly oriented. Sometimes, the anchor is first placed in the wellbore by using instrumentation for positioning the orienting receptacle in the anchor so that in a separate trip, the whipstock can be latched, with the correct ramp orientation, into the anchor. Some systems can run the anchor and whipstock together in a single trip and set the anchor when the desired ramp orientation is achieved. Some anchors have spiral mounting threads to engage a similar thread in the casing, so that the whipstock ramp will be properly oriented when attached to the anchor that has been advanced down the spiral mounting thread, as shown in U.S. Pat. No. 5,871,046. Similar mounting systems for anchors can be seen in U.S. Pat. No. 6,510,898 and PCT Application WO99/31348.

Horizontal and highly deviated wells pose a unique problem when using whipstocks and attempting to make a low-side exit with a downward-facing whipstock ramp. Gravity causes the upper unanchored end of the whipstock to tilt toward the low side of the horizontally placed casing. If the lateral is to be created on the high side of the casing or formation, the whipstock ramp will be upward-facing, so that if the uphole end of the whipstock is pulled by gravity toward the lower side of the lateral, subsequent re-entry into the lateral with other tools is not a problem because the tools will have ample clearance to travel onto the ramp and into the window previously made by the mills. However, if the whipstock ramp is oriented facing toward the low side of the horizontal casing and there is a need for re-entry into the lateral, the tool being advanced can either jam on the back side of the whipstock, or, if it is a mill, it can actually start milling the back of the whipstock from behind the ramp.

The present invention geometrically addresses the issue and resolves it by allowing the whipstock ramp, from upper end to lower end, to first be upward-facing and spiral to downward-facing, so that when the upper end of the whipstock is positioned flush against the bore of the casing, re-entry into the window is enabled. To position the exit in the ultimately desired low-side exit orientation, the whipstock ramp spirals around the whipstock. Those skilled in the art will better appreciate additional aspects of the invention from a review of the description of the preferred embodiment and the associated drawings, while recognizing that the full scope of the invention is to be determined by the appended claims.

SUMMARY OF THE INVENTION

A whipstock features a spiral ramp so that, in a horizontal run, access to a milled window with other tools is not impeded because such tools can travel onto the ramp and still be directed through the window. Angular rotation of the ramp can be at 180° or more and the pitch is selected to avoid getting the equipment being advanced into a bind. Optionally, a guide rail or groove can be configured into the whipstock ramp to help the mill follow the spiral track until the desired orientation is obtained and the track ends to allow separation of the mill from the track. A slot can be provided near the ramp upper end to aid in retrieval operations.

DETAILED DESCRIPTION OF THE PREFERRED EMBODIMENT

Figure 1:
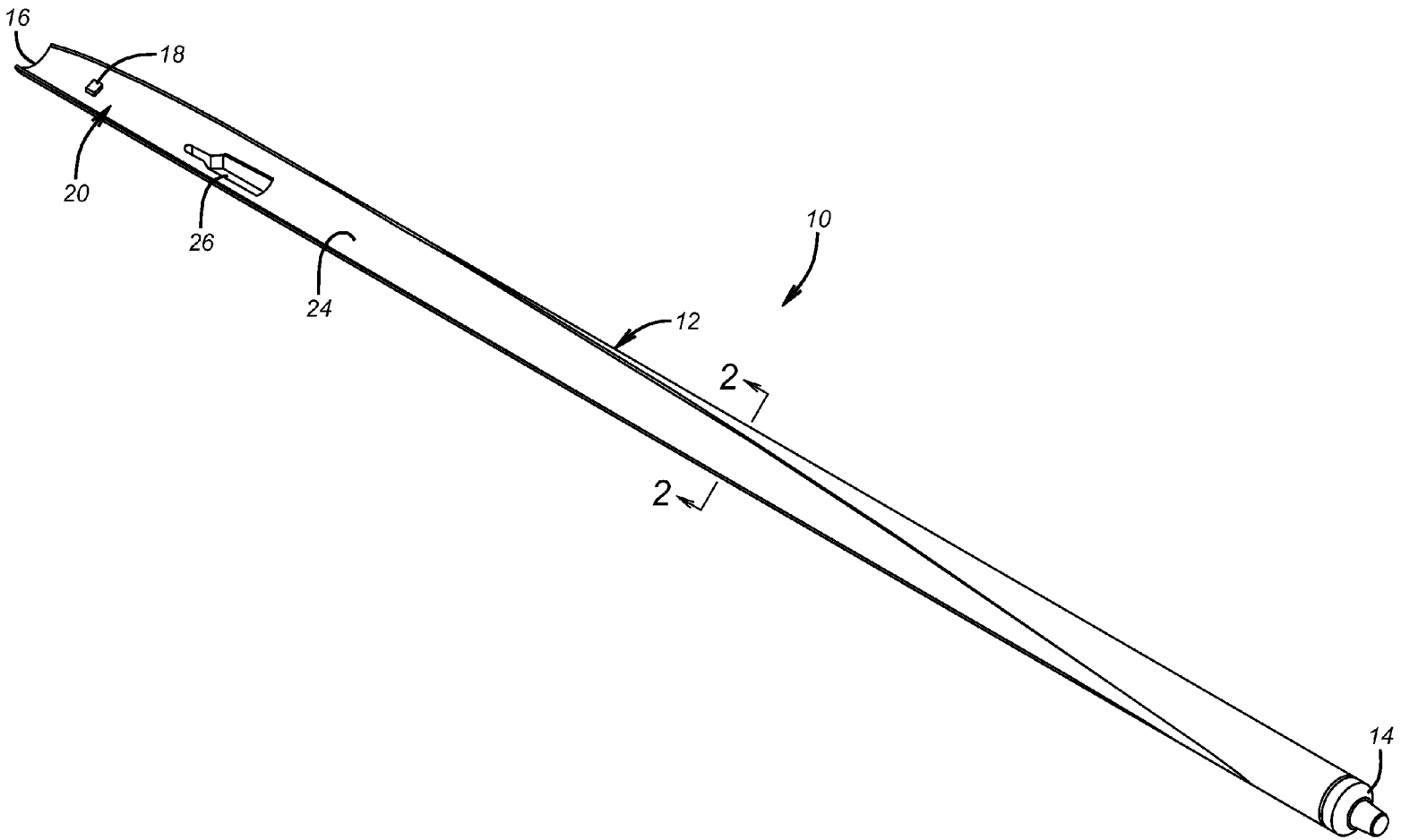
FIG. 1 is a perspective view of a whipstock showing a spiral ramp.

Referring to FIG. 1, the whipstock 10 has a generally cylindrical body 12 and a lower end 14 that is attached to a support that is not shown. Anchors that support whipstocks are well known in the art and are not a part of the present invention. Near the upper end 16 is a lug 18 that can be used to attach the milling system that is also not shown. Before the onset of mill rotation, the connection to the lug 18 breaks and the descent of the initial mill will mill off the lug as the milling system progresses down the ramp 20. The ramp 20 has a rounded section so that the mill 32 can be nested in the ramp face 24. Although the preferred design of the whipstock is an external ramp 20, "ramp" as used herein is intended to have a broader meaning to encompass any conveyance on the body that directs a downhole tool between spaced positions.

Figure 5:
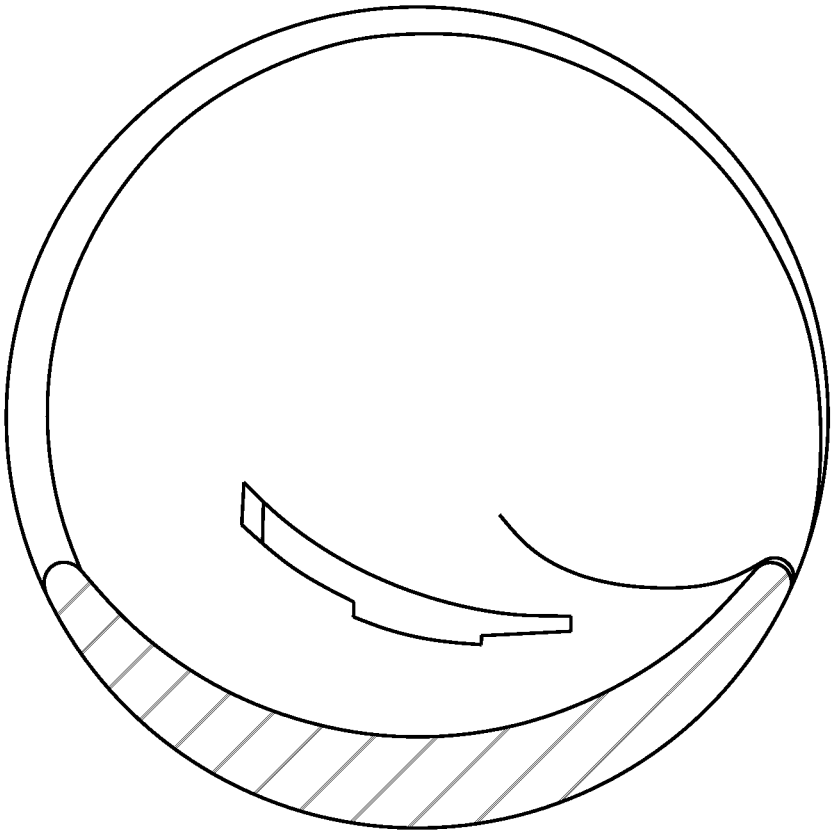
FIG. 5 is an end view looking down at the whipstock ramp from the upper end where the retrieval slot is located.
Figure 6:
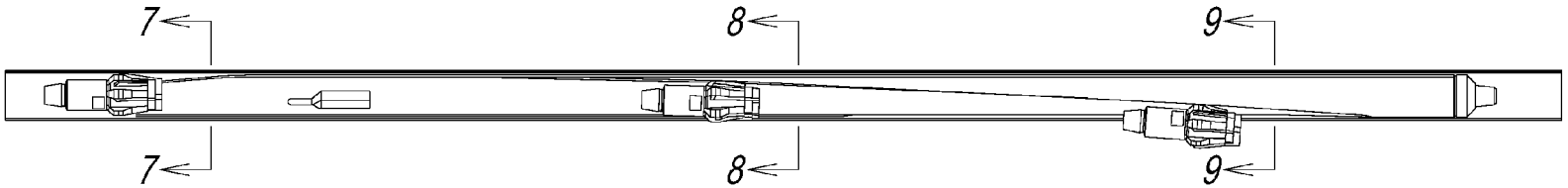
FIG. 6 shows a mill in three positions on the spiral whipstock ramp.
Figure 9:
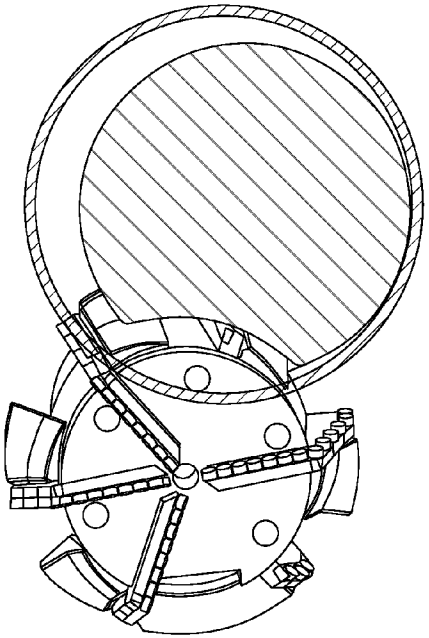
FIG. 9 is the view along line 9-9 of FIG. 6.
Figure 8:
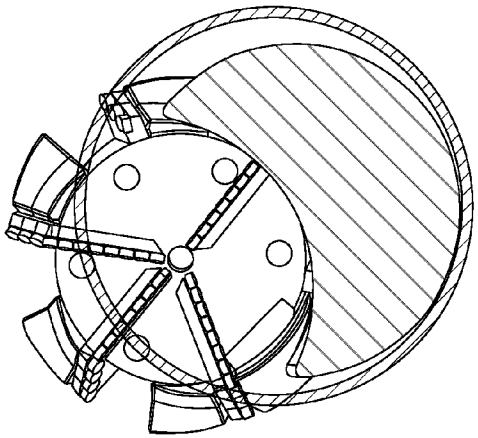
FIG. 8 is the view along line 8-8 of FIG. 6.
Figure 7:
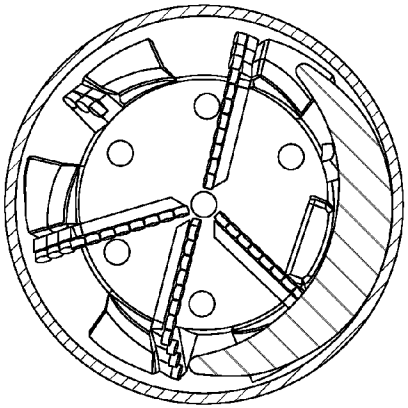
FIG. 7 is the view along line 7-7 of FIG. 6.

The ramp face 24 preferably has a spiral orientation so that, if the whipstock is, for example, in a horizontal run in a borehole and one looks from the upper end 16 to the lower end 14, as in FIG. 5, and the top side (high-side) of the horizontal run is considered 0° and rising in the clockwise direction, then the ramp face 24 should be between 315° and 45°, so that if the upper end 16 lays on the low side of the casing or formation (due to its own weight, since there is no anchor or other support near the upper end 16), there will still be clearance for subsequently run tools to clear the upper end 16 by traversing up onto the whipstock ramp face 24. This is to be contrasted with a linear non-spiraled whipstock ramp on which for a lateral, looking down from a horizontal run, the unsupported upper end would sag so that after removing the milling system and when attempting to deploy subsequently run equipment into the lateral from above, the upper end of the whipstock would be pulled by gravity closer toward the low side of the casing or formation, so that subsequently run tools could be hindered from re-entry into the lateral. In the latter scenario, if the subsequently run tool is another mill; the mill could start milling the whipstock from the back side of the whipstock. This could be a big problem, especially if the retrieval slot portion of that whipstock is milled away from the rest of the whipstock.

The spiral orientation allows this problem to be minimized or avoided as the sag of the casing-engaging bottom side (low side) of the upper end 16 is anticipated and the whipstock ramp face 24 is oriented in a range of angular orientation so that subsequent tools tend to traverse onto the whipstock face for guidance to the window along the preferably spiral ramp. It is preferred that, looking downhole from upper end 16 to lower end 14, the spiral ramp curves to the right in a helical manner; however, a spiral ramp that curves to the left in a helical manner is also contemplated. The pitch of the spiral should be large enough to allow progress of the milling system along the spiral path, as shown in FIGS. 6-9, without getting into a bind. Some of the variables in determining this are the mill and supporting string size and the profile dimension of the ramp face 24. The pitch can be constant or variable. The spiral need not be rounded but can comprise in connected segments joined at small angles.

Figure 3:
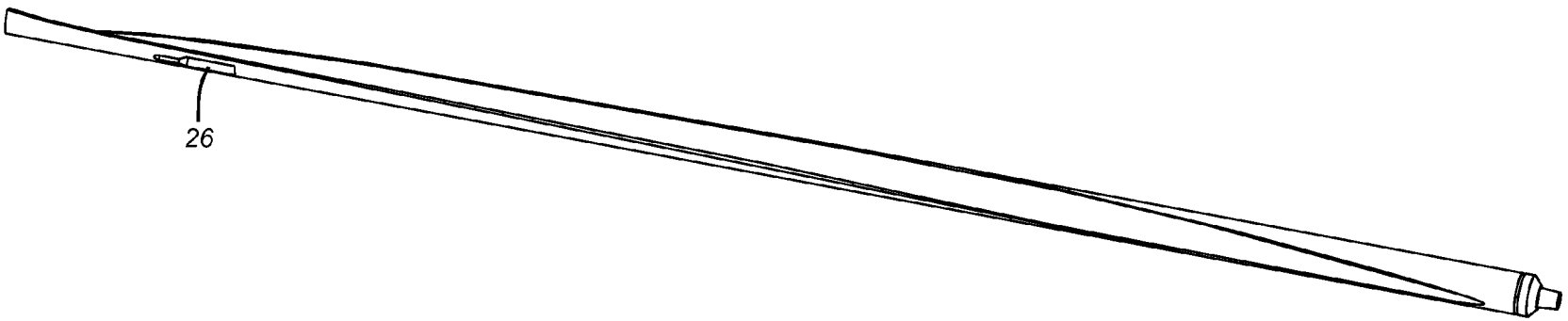
FIG. 3 is a perspective view of a whipstock with a spiral ramp that extends about 180° showing a retrieval slot in greater detail.

The preferred total angular reorientation is between 90° and 135°, although the range can extend as long as 180°, as shown in FIG. 3, depending on the orientation of the lateral exit that is desired. Keeping the pitch as large as possible and the total reorientation as small as possible, while still maintaining the ramp face orientation near the upper end 16 in a target range between 315° and 45°, is the ideal situation. A target pitch would be in the range of a change in angular orientation of 45° in about 3', although that guidance is variable with the overall whipstock diameter.

Figure 4:
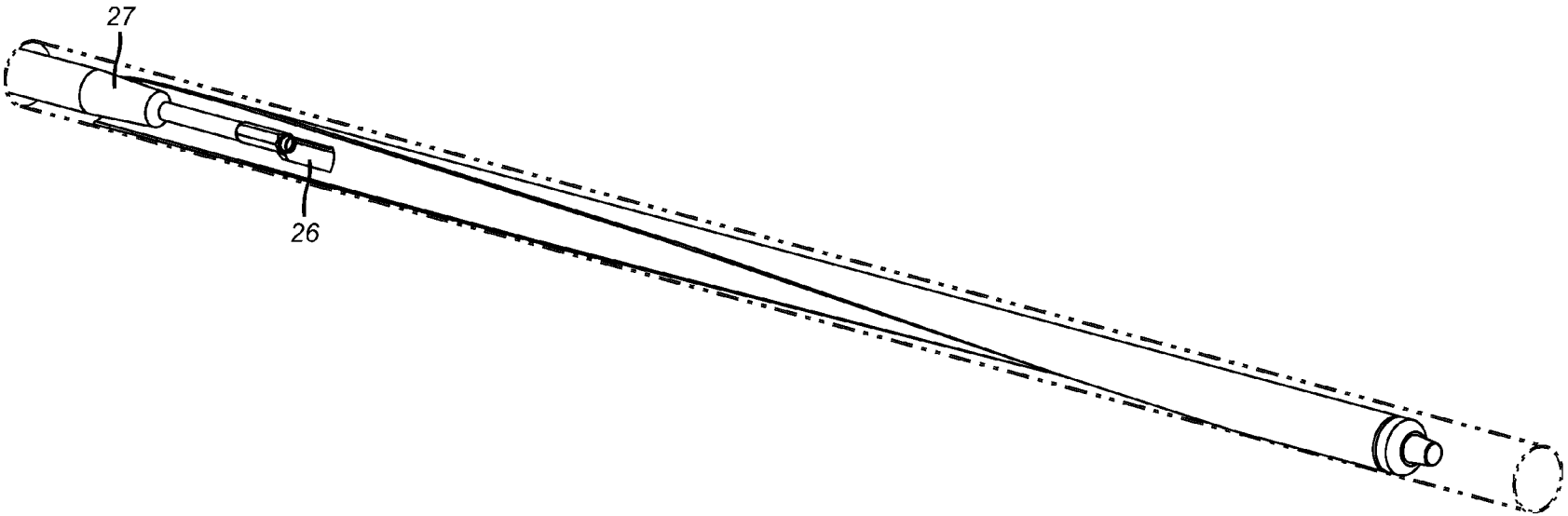
FIG. 4 shows a retrieval tool in the retrieval slot in the whipstock ramp face.

The whipstock ramp can also have an opening 26 that is used to engage the whipstock 10 with a retrieving tool 27, as shown in FIG. 4, to release the anchor and retrieve the whipstock 10.

Figure 2:
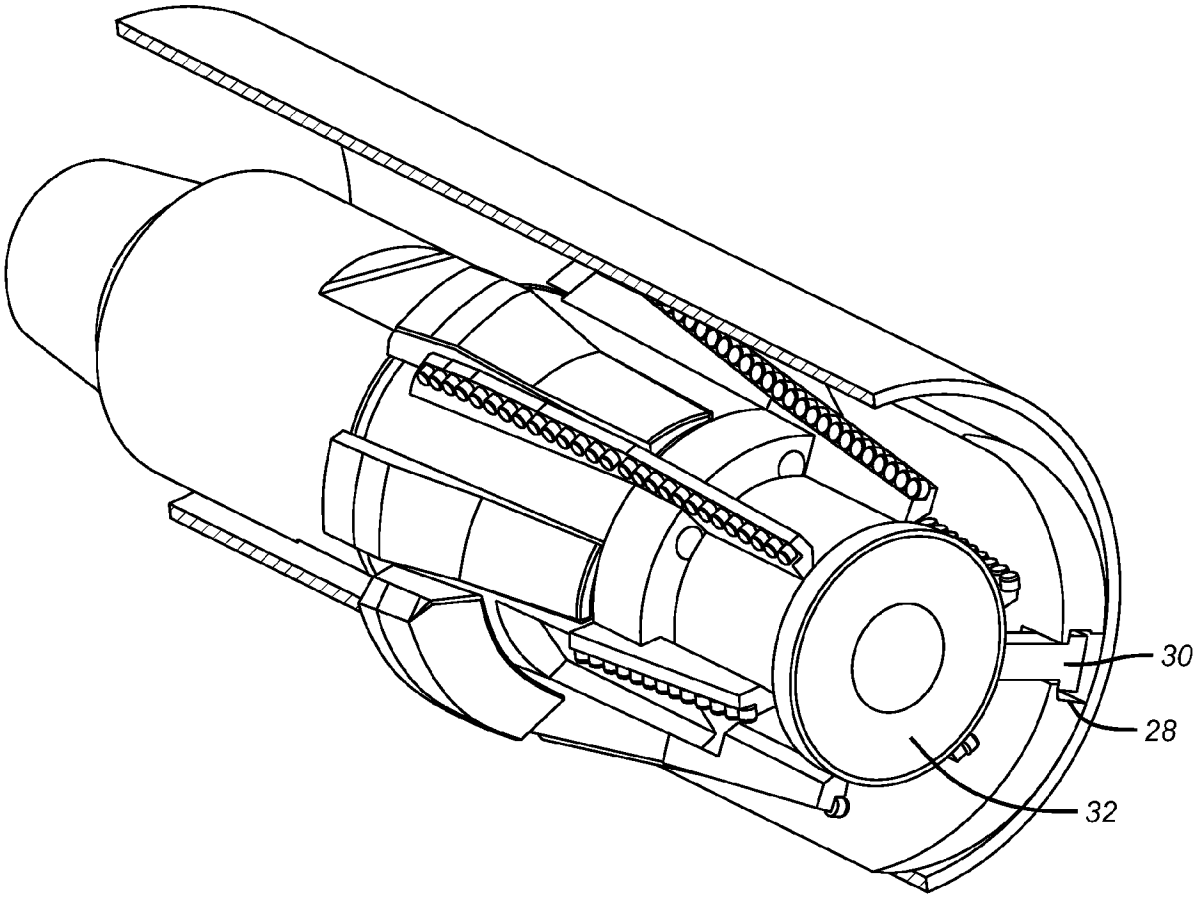
FIG. 2 is a section view along lines 2-2 of FIG. 1 showing the use of an optional track to guide the mill along the whipstock ramp until the track ends and the mill can separate from the ramp.
Figure 10:
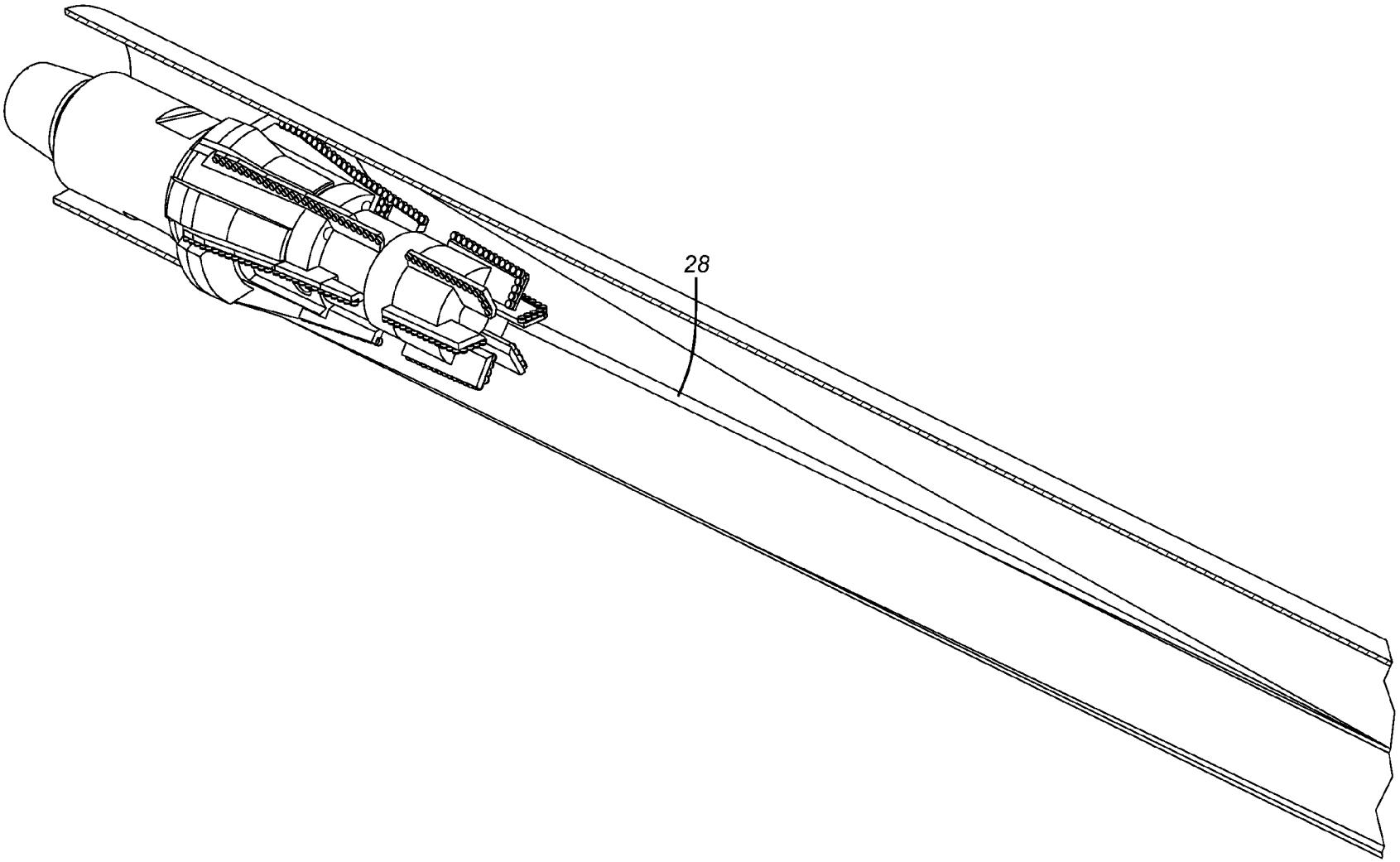
FIG. 10 shows the track extending down the whipstock ramp.

FIGS. 2 and 10 illustrate the use of a track 28 that can have a dovetail shape to retain a similarly shaped lug 30 as a mill 32 advances on the ramp face 24. The track 28 ends near the lower end of the whipstock ramp face 24 so that the mill 32 can separate from the ramp face 24 as the window milling ends and the lateral is extended.

The above description is illustrative of the preferred embodiment and many modifications may be made by those skilled in the art without departing from the invention whose scope is to be determined from the literal and equivalent scope of the claims below.

We claim:

1. A whipstock for subterranean use with at least one mill, comprising:

an elongated body having upper and lower ends and an axis running therebetween and a whipstock ramp having an arcuate surface when viewed in a section perpendicular to said axis to guide the mill so that the mill extends beyond said arcuate surface, said arcuate surface having different angular orientations about said axis when viewed in discrete sections taken perpendicularly to said axis.

2. The whipstock of claim 1, wherein:

said whipstock ramp follows a spiral path.

3. The whipstock of claim 2, wherein:

said spiral turns to the right or to the left going from said upper end to said lower end.

4. The whipstock of claim 2, wherein:

said spiral has a constant or variable pitch.

5. The whipstock of claim 4, wherein:

said spiral has a constant pitch.

6. The whipstock of claim 4, wherein:

said pitch turns the whipstock ramp 45° in 3' or less.

7. The whipstock of claim 2, wherein:

said spiral extends for up to 180° of rotation.

8. The whipstock of claim 1, wherein:

said whipstock ramp has a guide running along its length.

9. The whipstock of claim 8, wherein:

said guide has a dovetail shape.

10. The whipstock of claim 1, wherein:

said whipstock ramp comprises a retrieval slot.

* * * * *